US011322914B2

(12) United States Patent
Hioki

(10) Patent No.: US 11,322,914 B2
(45) Date of Patent: May 3, 2022

(54) SPARK PLUG

(71) Applicant: NGK SPARK PLUG CO., LTD., Nagoya (JP)

(72) Inventor: Ryo Hioki, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 17/383,616

(22) Filed: Jul. 23, 2021

(65) Prior Publication Data

US 2022/0059998 A1 Feb. 24, 2022

(30) Foreign Application Priority Data

Aug. 19, 2020 (JP) ..... JP2020-138501

(51) Int. Cl.
*H01T 13/32* (2006.01)

(52) U.S. Cl.
CPC ..... *H01T 13/32* (2013.01)

(58) Field of Classification Search
CPC ..... H01T 13/32
See application file for complete search history.

(56) References Cited

U.S. PATENT DOCUMENTS 8,378,560 B2 * 2/2013 Suzuki ..... H01T 13/39 313/142
8,476,817 B2 * 7/2013 Miyashita ..... H01T 13/32 313/141
2002/0121849 A1 * 9/2002 Kanao ..... H01T 13/39 313/141
2011/0025185 A1 * 2/2011 Torii ..... H01T 13/39 313/141
2014/0152170 A1 * 6/2014 Kasuya ..... H01T 13/32 313/141
2018/0323584 A1 * 11/2018 Igarashi ..... H01T 13/39

FOREIGN PATENT DOCUMENTS

WO 2017/077688 A1 5/2017

* cited by examiner

*Primary Examiner* — Kevin Quarterman
(74) *Attorney, Agent, or Firm* — Sughrue Mion, PLLC

(57) ABSTRACT

A spark plug is provided with a center electrode and a ground electrode. The ground electrode includes an electrode tip, an electrode base material, an intermediate member and a first melt portion. The intermediate member is disposed between the electrode tip and the electrode base material. The first melt portion contains components of the electrode base material and the intermediate member, and is disposed at least at a part of the boundary between the electrode base material and the intermediate member. In a cross section including the axis of the ground electrode, the boundary line between the intermediate member and the first melt portion has at least two first projection portions projecting toward the electrode tip side, and the boundary line between the electrode base material and the first melt portion has at least two second projection portions projecting toward the opposite side of the first projection portions.

2 Claims, 6 Drawing Sheets

SPARK PLUG

BACKGROUND

The present invention relates to a spark plug used for an internal combustion engine.

As an ignition means of an internal combustion engine such as an engine for an automobile, a spark plug is used. As a structure for generating spark discharge, the spark plug is provided with a center electrode and a ground electrode. For example, the surfaces of the center electrode and the ground electrode which face each other are provided with respective electrode tips made of noble metal material in order to improve ignitability of the spark plug.

In some spark plugs, the configurations of the center electrode and the ground electrode are devised to reduce the amount of use of noble metal. For example, in International Patent Application No. 2017/077688 (hereinafter is referred to as "WO2017/077688"), a spark plug is disclosed in which in at least one of a center electrode and a ground electrode, a noble metal tip is attached on a ground electrode base material via an intermediate member.

The ground electrode of the spark plug in WO2017/077688 is provided with a ground electrode base material 31, a noble metal tip 351, an intermediate member 353 and a first melt portion 352. The first melt portion 352 is formed, by laser welding, between the noble metal tip 351 and the intermediate member 353. The first melt portion 352 is a portion obtained by melting and solidifying a component of the noble metal tip 351 and a component of the intermediate member 353. In addition, a second melt portion 354 is formed at least at the position of the intersection with the axis of the noble metal tip 351 between the ground electrode base material 31 and the intermediate member 353. The second melt portion 354 is a portion obtained by melting and solidifying, by resistance welding, a component of the ground electrode base material 31 and a component of the intermediate member 353.

In this way, by fixing the noble metal tip to the ground electrode base material via the intermediate member, the joining strength of the noble metal tip can be improved, while reducing the amount of use of the noble metal tip made of a relatively expensive material. However, there is some room for improvement in the configuration of the ground electrode to increase the joining strength between the ground electrode base material and the intermediate member.

SUMMARY

In view of the foregoing, an object of the present invention is to provide a configuration of a melt portion which is capable of further increasing the joining strength between a ground electrode base material and an intermediate member in a spark plug.

The present invention is one for solving at least a part of the above problem, and it can be realized by the following aspect.

A spark plug comprises: a center electrode; and a ground electrode, wherein the ground electrode includes: an electrode tip having a facing surface facing a distal end portion of the center electrode; an electrode base material supporting the electrode tip; an intermediate member disposed between the electrode tip and the electrode base material; and a melt portion containing a component of the electrode base material and a component of the intermediate member, and disposed at least at a part of a boundary between the electrode base material and the intermediate member, and wherein a part of the melt portion which is formed at a position radially inside the facing surface includes, when observing a cross section including an axis of the ground electrode, a boundary line between the intermediate member and the melt portion which has at least two first projection portions projecting toward an electrode tip side and a boundary line between the electrode base material and the melt portion which has at least two second projection portions projecting toward an opposite side of the first projection portions.

DETAILED DESCRIPTION

In the following, while referencing the drawings, embodiments of the present invention will be explained. In the following explanation, the same symbols are applied to the same components, and their names and functions are also the same. Redundant explanation is therefore omitted.

First Embodiment

In the present embodiment, as an example, a spark plug 1 will be explained.

(Whole Configuration of Spark Plug)

Figure 1:
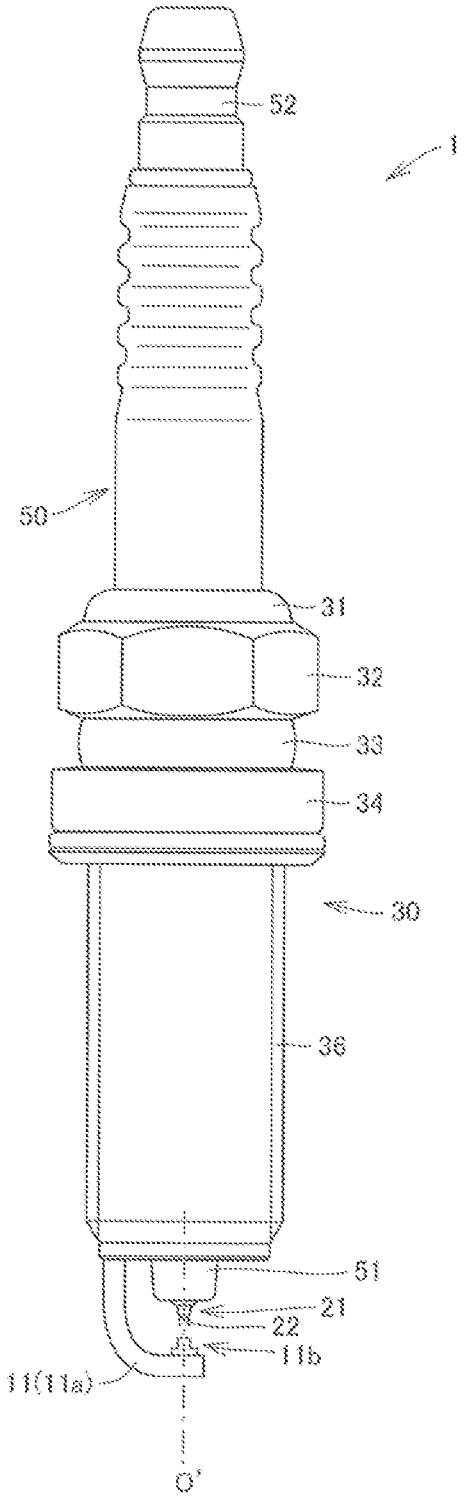
FIG. 1 is a side view showing the appearance of a spark plug according to an embodiment.

First, the whole configuration of the spark plug 1 will be explained while referencing FIG. 1. The spark plug 1 is provided with an insulator 50 and a main metal fitting 30. In FIG. 1, the lower side on the paper is referred to as the distal end side of the spark plug 1, and the upper side on the paper is referred to as the rear end side of the spark plug 1. In addition, in FIG. 1, the axis of the spark plug 1 is shown by "O'". In the following, the direction parallel to the axis O' is referred to as an axial direction, and the radial direction of a circle with the axis O' as a center which is positioned on a plane vertical to the axis O' is simply referred to as a radial direction, and the circumferential direction of this circle is simply referred to as a circumferential direction.

The insulator 50 is a substantially cylindrical member extending in the longitudinal direction of the spark plug 1. The insulator 50 is made of a material excellent in insulation, heat resistance and thermal conductivity. The insulator 50 is made of, for example, an alumina-based ceramic. One end portion (distal end portion) of the insulator 50 is provided with a center electrode 21. In addition, the other end portion (rear end portion) of the insulator 50 is attached with a terminal metal fitting 52.

The center electrode 21 is held in an axial hole of the insulator 50 in a state in which the distal end portion (electrode distal end portion 22) of the center electrode 21 projects from a distal end portion 51 of the insulator 50. The center electrode 21 has a substantially columnar shape, and the distal end part thereof is formed in a tapered shape such that the diameter is gradually reduced toward the electrode distal end portion 22. The electrode distal end portion 22 is provided to the distal end of the center electrode 21, and has a substantially columnar shape having the same diameter as the reduced diameter of the distal end part of the center electrode 21. The electrode distal end portion 22 is disposed so as to substantially correspond to the axis O'.

The center electrode 21 is made of a metal material, as a base material, such as an Ni-based alloy containing Ni (nickel) as a main component. As an alloy element to be added to the Ni-based alloy, for example, Al (aluminum) can be cited. The center electrode 21 may have, inside thereof, a core material formed from a metal excellent in thermal conductivity made of a metal material such as Cu (copper) and Cu alloy.

The electrode distal end portion 22 can be formed by, for example, a noble metal tip formed in a columnar shape, and is joined to the distal end of the center electrode 21 by, for example, welding. The noble metal tip contains one kind of a noble metal selected from, for example, Pt, Rh, Ir and Ru, and the content ratio of the noble metal is 50 wt % or greater.

The main metal fitting 30 is a cylindrical member fixed to a screw hole of an internal combustion engine. In the present embodiment, the main metal fitting 30 has a substantially cylindrical shape, and is provided so as to cover a part of the insulator 50. The main metal fitting 30 is made of a metal material having conductivity. As such a metal material, a metal material containing, as a main component, a low carbon steel or iron can be cited. The main metal fitting 30 mainly includes a caulking portion 31, a tool engagement portion 32, a curved portion 33, a seat portion 34, a barrel portion 36, and the like.

The caulking portion 31 is a portion curved toward the insulator 50 side in the rear end side of the main metal fitting 30. The tool engagement portion 32 is a portion connected to the distal end side of the caulking portion 31, and engaging with a tool such as a wrench used when the main metal fitting 30 is attached to a screw hole of the internal combustion engine (cylinder head). The seat portion 34 is positioned more on the distal end side than the tool engagement portion 32, and projects radially outward from the main metal fitting 30.

The curved portion 33 is a thin portion connecting the tool engagement portion 32 with the seat portion 34. The barrel portion 36 is positioned on the distal end side of the seat portion 34, and is formed with, on the outer periphery thereof, a screw part. A ring-shaped gasket is disposed between the seat portion 34 and the screw part of the barrel portion 36. When the spark plug 1 is attached to the internal combustion engine, the screw groove (not shown) formed on the outer periphery of the barrel portion 36 is screwed to the screw hole of the internal combustion engine. At this time, the ring-shaped gasket is sandwiched by the seat portion 34 and the cylinder head, thereby ensuring airtightness in the screw hole.

In addition, the main metal fitting 30 is joined with a ground electrode 11. The ground electrode 11 mainly includes an electrode base material 11*a* and a projection part 11*b*. The electrode base material 11*a* has a bar shape curved in a substantially L shape. The base end portion of the electrode base material 11*a* is joined to the distal end surface of the barrel portion 36 of the main metal fitting 30. The distal end portion of the electrode base material 11*a* faces the electrode distal end portion 22 of the center electrode 21.

The electrode base material 11*a* is made of a metal material such as an Ni-based alloy containing Ni (nickel) as a main component. As an alloy element to be added to the Ni-based alloy, for example, Mn (manganese), Cr (chromium), Al (aluminum) and Fe (iron) can be cited. The ground electrode 11 may have, inside thereof, a core material formed from a metal excellent in thermal conductivity made of a metal material such as Cu (copper) and Cu alloy.

As a metal material used for the electrode base material 11*a*, specifically, Inconel (registered trade mark) and an NCF material specified by JIS G-4901 can be cited. These metal materials have oxidation consumption resistance.

The projection part 11*b* is disposed on the distal end side of the electrode base material 11*a*, so as to project toward the electrode distal end portion 22 side of the center electrode 21. The distal end of the projection part 11*b* is a facing surface (specifically, a top surface 12*a*) facing the electrode distal end portion 22 of the center electrode 21. The projection part 11*b* projects toward the electrode distal end portion 22 side so as to substantially correspond to the axis O'.

Similar to the electrode distal end portion 22 of the center electrode 21, the projection part 11*b* is composed of an electrode tip (specifically, an electrode tip 12) containing noble metal and the like.

(Configuration of Projection Part of Ground Electrode)

Figure 2:
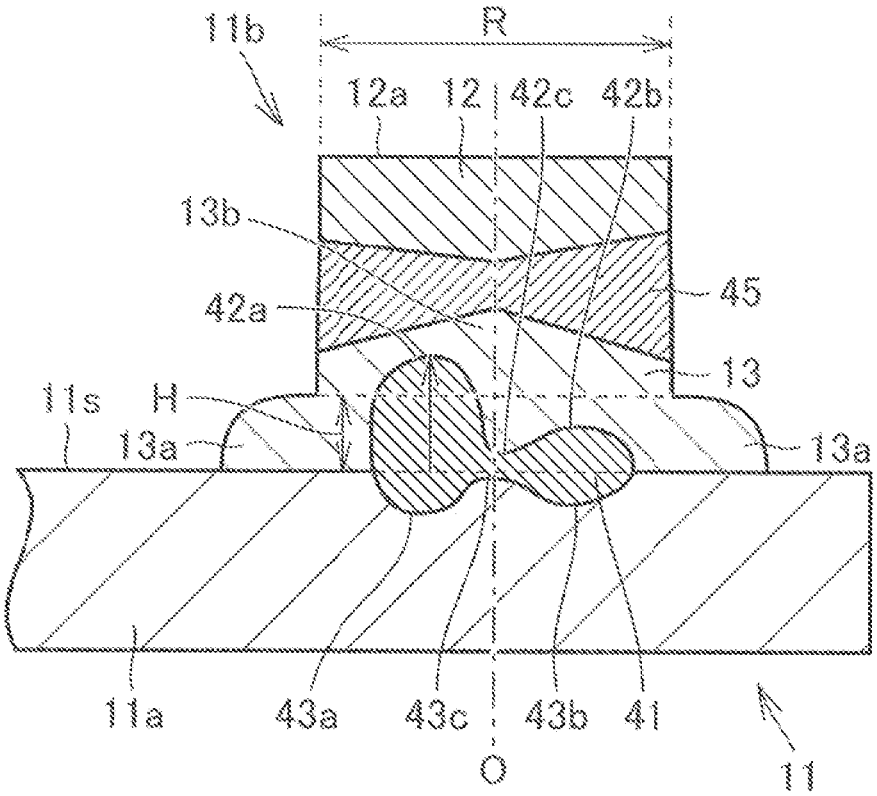
FIG. 2 is a sectional view schematically showing the internal configuration of a ground electrode of the spark plug according to a first embodiment.

Next, the configuration around the projection part 11*b* of the ground electrode 11 will be explained. In FIG. 2, the configuration in a cross section of the projection portion 11*b* of the ground electrode 11 is shown. FIG. 2 is a drawing showing the configuration of an arbitrary cross section including an axis O of the substantially columnar projection part 11*b*. In addition, the axis O of the projection part 11*b* substantially corresponds to the axis O' of the spark plug 1.

The projection part 11*b* of the ground electrode 11 is formed on the electrode base material 11*a*. The electrode base material 11*a* supports the projection part 11*b* composed of the electrode tip 12 and the like.

The projection part 11*b* is mainly composed of the electrode tip 12, an intermediate member 13, a first melt portion 41 and a second melt portion 45.

The electrode tip 12 can be formed by, for example, a noble metal tip formed in a columnar shape. The electrode tip 12 forms the distal end portion of the projection part 11*b*, and has a top surface 12*a* (facing surface) facing the electrode distal end portion 22 of the center electrode 21. In addition, the length in the radial direction of the electrode tip 12 is set as a diameter R (see FIG. 2). Similar to the electrode distal end portion 22 of the center electrode 21, the electrode tip 12 contains one kind of a noble metal selected from, for example, Pt, Rh, Ir and Ru, and the content ratio of the noble metal is 50 wt % or greater.

The intermediate member 13 is disposed between the electrode tip 12 and the electrode base material 11*a*. In the present embodiment, the intermediate member 13 is disposed on a surface 11*s* of the electrode base material 11*a* on the side facing the center electrode 21. The intermediate member 13 is made of a metal material such as an Ni-based alloy containing Ni (nickel) as a main component. As an alloy element to be added to the Ni-based alloy, for example, Mn (manganese), Cr (chromium), Al (aluminum) and Si (silicon) can be cited. The intermediate member 13 may be formed by using the same material as or different material from that of the electrode base material 11*a* of the ground electrode 11.

The intermediate member 13 mainly includes a body portion 13*b* and a flange portion 13*a*. The body portion 13*b* is positioned on the electrode tip 12 side, and has a substantially columnar shape. The flange portion 13*a* is positioned on the electrode base material 11*a* side, and is provided such that the diameter of the body portion 13*b* is expanded in the radial direction. In addition, in the flange portion 13*a*, the length, in the axial direction, from the surface 11*s* of the electrode base material 11*a* to the boundary between the flange portion 13*a* and the body portion 13*b* is set as a height H of the flange portion 13*a* (see FIG. 2).

As will be mentioned below, the electrode tip 12 and the intermediate member 13 are joined to the electrode base material 11*a* of the ground electrode 11 by welding (for example, laser welding or resistance welding). In the joining process by the welding, the first melt portion (melt portion) 41 is formed at the boundary between the electrode base material 11*a* and the intermediate member 13, and the second melt portion 45 is formed at the boundary between the electrode tip 12 and the intermediate member 13.

The first melt portion 41 is formed at least at a part of the boundary between the electrode base material 11*a* and the intermediate member 13. The first melt portion 41 contains a component of the electrode base material 11*a* and a component of the intermediate member 13. That is, the first melt portion 41 is made of an alloy of a metal material contained in the electrode base material 11*a* and a metal material contained in the intermediate member 13. The first melt portion 41 is formed by, for example, resistance welding.

The first melt portion 41 is formed in an area radially inside the diameter R of the top surface 12*a* of the electrode tip 12. As will be mentioned below, the shape and the size of the first melt portion 41 can be changed by properly changing the shape and the size of a projection 13*c* (see FIG. 3A) formed in the intermediate member 13 before welding, or conditions of the resistance welding.

In FIG. 2, the internal configuration of the projection part 11*b* of the ground electrode 11 is shown. FIG. 2 is a drawing schematically showing the state of a cross section including the axis O of the projection part 11*b* of the ground electrode 11. Such a state of the cross section can be observed by using, for example, an optical microscope or an electron microscope.

In an arbitrary cross section including the axis O of the projection part 11*b*, the first melt portion 41 includes, in the boundary with the intermediate member 13, two first projection portions 42*a* and 42*b* projecting toward the electrode tip 12 side, and a first recess portion 42*c* positioned between these two first projection portions 42*a* and 42*b*. The first projection portion 42*a* and the first projection portion 42*b* are formed so as to be circumferentially continued along the circumference of a circle with the axis O as a center. In addition, the first recess portion 42*c* is provided in an area including the axis O.

Further, in an arbitrary cross section including the axis O of the projection part 11*b*, the first melt portion 41 includes, in the boundary with the electrode base material 11*a*, two second projection portions 43*a* and 43*b* projecting toward the electrode base material 11*a* side (that is, the opposite side of the first projection portions 42*a* and 42*b*), and a second recess portion 43*c* positioned between these two second projection portions 43*a* and 43*b*. The second projection portion 43*a* and the second projection portion 43*b* are formed so as to be circumferentially continued along the circumference of a circle with the axis O as a center. In addition, the second recess portion 43*c* is provided in an area including the axis O.

In an arbitrary cross section including the axis O of the projection part 11*b*, the first melt portion 41 includes the first projection portions 42*a* and 42*b* projecting toward the electrode tip 12 side and the first recess portion 42*c* provided therebetween, thereby increasing the surface area of the first melt portion 41 in the boundary between the first melt portion 41 and the intermediate member 13. Further, in an arbitrary cross section including the axis O of the projection part 11*b*, the first melt portion 41 includes the second projection portions 43*a* and 43*b* projecting toward the electrode base material 11*a* side and the second recess portion 43*c* provided therebetween, thereby increasing the surface area of the first melt portion 41 in the boundary between the first melt portion 41 and the electrode base material 11*a*.

With this, the joining strength between the electrode base material 11*a* and the intermediate member 13 which are joined to each other via the first melt portion 41 can be increased. In addition, the first melt portion 41 is formed in the area radially inside the diameter R of the top surface 12*a* of the electrode tip 12, thereby further increasing the joining strength between the electrode base material 11*a* and the intermediate member 13.

In addition, in the present embodiment, the height of at least one of the two first projection portions 42*a* and 42*b* (in FIG. 2, the first projection portion 42*a*) projecting toward the electrode tip 12 side is higher than the height H of the flange portion 13*a*. Here, as shown by an arrow in FIG. 2, the height of the first projection portion 42*a* is a length from the virtual extension surface (shown by a broken line in FIG. 2) of the surface 11*s* of the electrode base material 11*a* to the top of the first projection portion 42*a* in the axial direction.

Since the height of the first projection portion 42*a* is higher than that of the flange portion 13*a*, a structure in which the intermediate member 13 hardly moves in the radial direction when a force in the radial direction is applied to the projection part 11*b* of the ground electrode 11 can be obtained.

The second melt portion 45 is disposed at least at a part of the boundary between the electrode tip 12 and the intermediate member 13. In the present embodiment, the second melt portion 45 is formed in the whole area of the boundary between the electrode tip 12 and the intermediate member 13. In other words, the second melt portion 45 is disposed between the electrode tip 12 and the intermediate member 13. The second meld portion 45 contains a component of the electrode tip 12 and a component of the intermediate member 13. That is, the second melt portion 45 is made of an alloy of a metal material contained in the electrode tip 12 and a metal material contained in the intermediate member 13. The second melt portion 45 is formed by, for example, laser welding.

Although not shown in FIG. 2, in the boundary between the electrode base material 11*a* and the intermediate member 13, a melt portion different from the first melt portion 41 may be formed at a position radially outside the diameter R of the top surface 12*a* of the electrode tip 12.

(Manufacturing Method for Ground Electrode)

Next, a manufacturing method for the spark plug 1 will be explained. Here, a manufacturing method of the projection part 11*b* of the ground electrode 11 will be mainly explained. In the manufacturing method of the spark plug 1, a well know manufacturing method can be applied to parts other than the projection part 11*b* of the ground electrode 11.

Figure 3A:
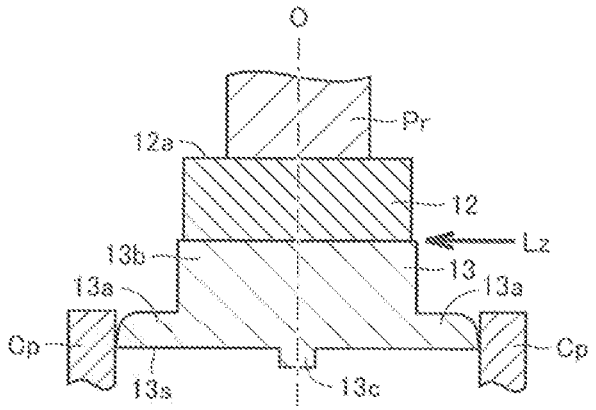
FIGS. 3A and 3B each are a schematic diagram showing the manufacturing process of a projection part of the ground electrode in order.
Figure 3B:
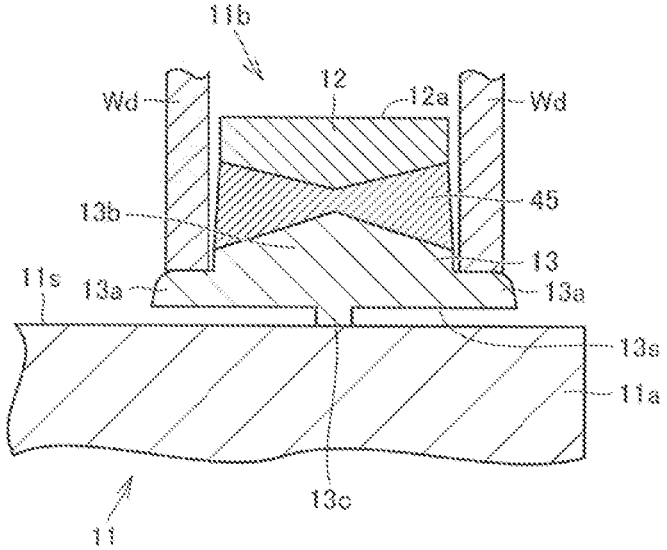

In FIG. 3A and FIG. 3B, a formation process of the projection part 11*b* is shown in order. When manufacturing the projection part 11*b*, the electrode tip 12 before welding and the intermediate member 13 before welding are prepared. The electrode tip 12 before welding has a substantially columnar shape.

The intermediate member 13 before welding includes the body portion 13*b*, the flange portion 13*a* and the projection 13*c*. The body portion 13*b* has a substantially columnar shape. The flange portion 13*a* is provided to one end portion of the substantially columnar body portion 13*b* such that the diameter of the body portion 13*b* is expanded. That is, the diameter of the flange portion 13*a* is larger than that of the body portion 13*b*. The projection 13*c* is a projection projecting from one end surface (an end surface 13*s* positioned on the side in which the flange portion 13*a* is provided) of the substantially columnar body portion 13*b*.

The electrode tip 12 and the intermediate member 13 are joined to the electrode base material 11*a* by performing, for example, welding processing such as laser welding and resistance welding.

First, the electrode tip 12 and the intermediate member 13 are joined to each other by laser welding. Specifically, as shown in FIG. 3A, the flange portion 13*a* of the intermediate member 13 is fixed by using a fastening tool Cp, and then the electrode tip 12 is placed on the other end surface (end surface on the opposite side of the end surface 13*s*) of the body portion 13*b* of the intermediate member 13. At this time, the axis of the substantially columnar electrode tip 12 and the axis of the substantially columnar body portion 13*b* of the intermediate member 13 are positioned on the axis O.

After that, in a state in which the top surface 12*a* of the electrode tip 12 is pressed by using a predetermined pressing member Pr, a laser Lz vertical to the axis O is irradiated to the contact part between the electrode tip 12 and the intermediate member 13 from the outside to the inside in the radial direction. The laser Lz is irradiated to the contact part between the electrode tip 12 and the intermediate member 13 by using, for example, an irradiation device such as a fiber laser irradiation device.

Then, with respect to the irradiation device of the laser Lz, the electrode tip 12 and the intermediate member 13 are relatively rotated about the axis O, so as to irradiate the laser Lz to the entire periphery of the contact part between the electrode tip 12 and the intermediate member 13. With this, the second melt portion 45 having a shape shown in FIG. 3B is formed between the electrode tip 12 and the intermediate member 13, and the electrode tip 12 and the intermediate member 13 are joined to each other.

At this time, the shape of the second melt portion 45 can be controlled by adjusting conditions such as the energy or the condensing position of the laser Lz, the rotation speed of the electrode tip 12 and the intermediate member 13, and the pressure generated by the pressing member Pr. For example, by increasing the rotation speed and the energy of the laser Lz, it is possible to reduce the difference between the thickness on the axis O and the thickness in the outer peripheral surface of the second melt portion 45.

Next, as shown in FIG. 3B, the intermediate member 13 joined with the electrode tip 12 is fixed, by resistance welding, to the surface 11*s* of the electrode base material 11*a* of the ground electrode 11. At this time, in a state in which, by a cylindrical welding electrode Wd, the surface on the opposite side of the end surface 13*s* of the flange portion 13*a* is pressed, electric current for welding flows between the electrode base material 11*a* and the intermediate member 13, and the resistance welding is performed. Since the resistance welding is started in a state in which the surface 11*s* of the electrode base material 11*a* is brought into contact with the projection 13*c* of the intermediate member 13, first, the electric current is concentrated to the projection 13*c*. Consequently, the projection 13*c* and a part of the electrode base material 11*a* which comes in contact with the projection 13*c* are melt, and the first melt portion 41 is formed.

After that, the end surface 13*s* of the intermediate member 13 comes in contact with the surface 11*s* of the electrode base material 11*a*, and the resistance welding of the end surface 13*s* of the intermediate member 13 and the electrode base material 11*a* is performed. Consequently, the first melt portion 41 shown in FIG. 2 is formed, and the electrode tip 12 and the intermediate member 13 are melted and fixed onto the electrode base material 11*a*.

The shape and the size of the first melt portion 41 can be controlled by adjusting the shape or the size of the projection 13*c*, or conditions for the resistance welding such as the magnitude of the electric current and the pressure of the welding electrode Wd.

For example, the longer the length in the axial direction of the projection 13*c* becomes, the longer the length in the axial direction of the first melt portion 41 (that is, the heights of the first projection portions 42*a* and 42*b* and the second projection portions 43*a* and 43*b*) becomes, and the longer the length in the radial direction vertical to the axial direction of the projection 13*c* becomes, the longer the length in the radial direction of the first melt portion 41 becomes.

Figure 4A:
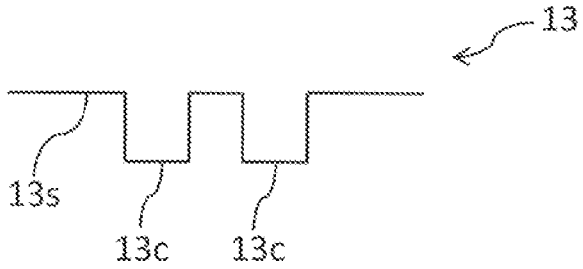
FIG. 4A is a sectional view schematically showing an example of a projection formed on the end surface of an intermediate member before welding.
Figure 4B:
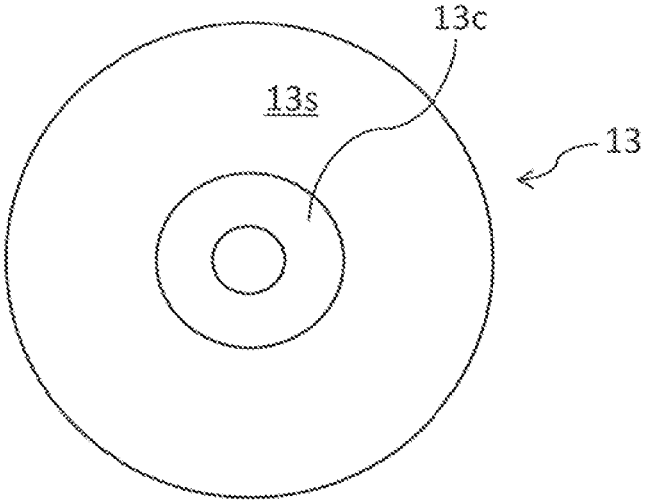
FIG. 4B is a plane view schematically showing an example of the projection formed on the end surface of the intermediate member before welding.

In FIG. 4A and FIG. 4B, an example of the shape of the projection 13*c* formed to the end surface 13*s* of the intermediate member 13 before the welding is shown. The projection 13*c* shown in FIG. 4A and FIG. 4B is formed in a doughnut shape in the middle part of the end surface 13*s*. For example, by using the intermediate member 13 including the projection 13*c* having such a shape, the first melt portion 41 having the first projection portions 42*a* and 42*b* and the second projection portions 43*a* and 43*b* shown in FIG. 2 can be formed.

Summary of First Embodiment

As mentioned above, the spark plug 1 according to the present embodiment is provided with the center electrode 21 and the ground electrode 11. The ground electrode 11 mainly includes the electrode tip 12, the electrode base material 11*a* for supporting the electrode tip 12, the intermediate member 13, and the first melt portion 41. The intermediate member 13 is disposed between the electrode tip 12 and the electrode base material 11*a*. The first melt portion 41 contains a component of the electrode base material 11*a* and a component of the intermediate member 13, and is disposed at least at a part of the boundary between the electrode base material 11*a* and the intermediate member 13. When the cross section including the axis O of the ground electrode 11 is observed, the boundary line between the intermediate member 13 and the first melt portion 41 includes at least the two first projection portions 42*a* and 42*b* projecting toward the electrode tip 12 side, and the boundary line between the electrode base material 11*a* and the first melt portion 41 includes at least the two second projection portions 43*a* and 43*b* projecting toward the opposite side of the first projection portions 43*a* and 43*b*.

According to the above configuration, the electrode tip 12 is fixed to the electrode base material 11*a* via the intermediate member 13 disposed therebetween, thereby firmly joining the electrode tip 12 onto the electrode base material 11*a* while reducing the amount of use of a relatively expensive electrode tip containing a noble metal.

In addition, in an arbitrary cross section including the axis O of the projection part 11*b*, the first melt portion 41 includes at least the two first projection portions 42*a* and 42*b* projecting toward the electrode tip 12 side, thereby increasing the surface area of the first melt portion 41 in the boundary between the first melt portion 41 and the intermediate member 13. Further, in an arbitrary cross section including the axis O of the projection part 11*b*, the first melt portion 41 includes at least the two second projection portions 43*a* and 43*b* projecting toward the electrode base material 11*a* side, thereby increasing the surface area of the first melt portion 41 in the boundary between the first melt portion 41 and the electrode base material 11*a*.

According to the above configuration, it is possible to increase the joining strength between the electrode base material 11*a* and the intermediate member 13 which are joined to each other via the first melt portion 41.

Second Embodiment

Next, a spark plug 1 according to a second embodiment will be explained. In the spark plug 1 according to the second embodiment, the configuration of a projection part 11*b* of a ground electrode 11 is different from that of the projection part 11*b* of the ground electrode 11 in the first embodiment. In the spark plug 1 according to the second embodiment, the configuration similar to that of the spark plug 1 according to the first embodiment can be applied to parts other than the projection part 11*b*.

Figure 5:
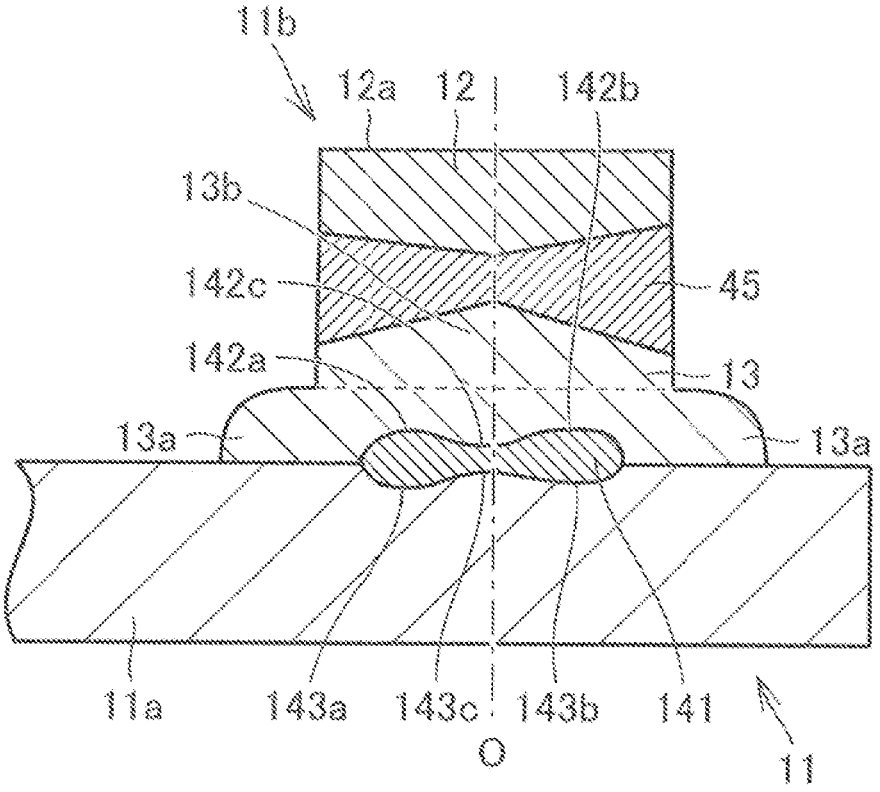
FIG. 5 is a sectional view schematically showing the internal configuration of the ground electrode of the spark plug according to a second embodiment.

In FIG. 5, the configuration in cross section of the projection part 11*b* of the ground electrode 11 provided to the spark plug 1 according to the second embodiment is shown.

The projection part 11*b* of the ground electrode 11 is formed on an electrode base material 11*a*. The projection part 11*b* is mainly composed of an electrode tip 12, an intermediate member 13, a first melt portion 141 and a second melt portion 45. In these components, the configuration similar to the first embodiment can be applied to the electrode tip 12, the intermediate member 13 and the second melt portion 45.

In the spark plug 1 according to the present embodiment, the shape of the first melt portion 141, more specifically, the shape of the boundary surface between the intermediate member 13 and the first melt portion 141 is different from the shape of the first melt portion 41 in the first embodiment.

The first melt portion 141 is disposed at least at a part of the boundary between the electrode base material 11*a* and the intermediate member 13. Similar to the first embodiment, the first melt portion 141 contains a component of the electrode base material 11*a* and a component of the intermediate member 13. The first melt portion 141 is formed by, for example, resistance welding.

As shown in FIG. 5, in an arbitrary cross section including an axis O of the projection part 11*b*, the first melt portion 141 includes, in the boundary with the intermediate member 13, two first projection portions 142*a* and 142*b* projecting toward the electrode tip 12 side, and a first recess portion 142*c* positioned between these two first projection portions 142*a* and 142*b*.

In addition, as shown in FIG. 5, in an arbitrary cross section including the axis O of the projection part 11*b*, the first melt portion 141 includes, in the boundary with the electrode base material 11*a*, two second projection portions 143*a* and 143*b* projecting toward the electrode base material 11*a* side (that is, the opposite side of the first projection portions 142*a* and 142*b*), and a second recess portion 143*c* positioned between these two second projection portions 143*a* and 143*b*.

In the present embodiment, the heights of the two first projection portions 142*a* and 142*b* shown in FIG. 5 are substantially the same as each other. In addition, the heights of these two first projection portions 142*a* and 142*b* are lower than the height H of the flange portion 13*a*. In this way, the first melt portion 141 has a substantially disk shape having, in the middle thereof, a recess (that is, the first recess portion 142*c* and the second recess portion 143*c*).

In the spark plug 1 according to the present embodiment, in an arbitrary cross section including the axis O of the projection part 11*b*, the first melt portion 141 includes the first projection portions 142*a* and 142*b* projecting toward the electrode tip 12 side, and the first recess portion 142*c* provided therebetween, thereby increasing the surface area of the first melt portion 141 in the boundary between the first melt portion 141 and the intermediate member 13. In addition, in an arbitrary cross section including the axis O of the projection part 11*b*, the first melt portion 141 includes the second projection portions 143*a* and 143*b* projecting toward the electrode base material 11*a* side, and the second recess portion 143*c* provided therebetween, thereby increasing the surface area of the first melt portion 141 in the boundary between the first melt portion 141 and the electrode base material 11*a*.

Consequently, it is possible to increase the joining strength between the electrode base material 11*a* and the intermediate member 13 which are joined to each other via the first melt portion 141.

Third Embodiment

Next, a spark plug 1 according to a third embodiment will be explained. In the spark plug 1 according to the third embodiment, the configuration of a projection part 11*b* of a ground electrode 11 is different from that of the projection part 11*b* of the ground electrode 11 in the first embodiment. In the spark plug 1 according to the third embodiment, the configuration similar to that of the spark plug 1 according to the first embodiment can be applied to parts other than the projection part 11*b*.

Figure 6:
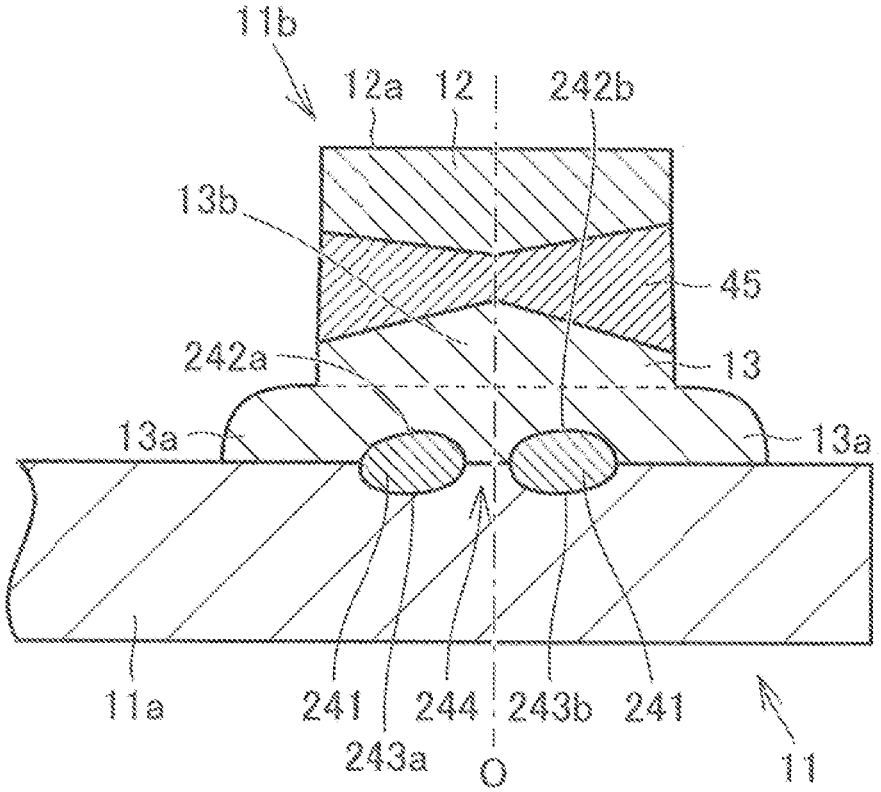
FIG. 6 is a sectional view schematically showing the internal configuration of the ground electrode of the spark plug according to a third embodiment.

In FIG. 6, the configuration in cross section of the projection part 11*b* of the ground electrode 11 provided to the spark plug 1 according to the third embodiment is shown.

The projection part 11*b* of the ground electrode 11 is formed on an electrode base material 11*a*. The projection part 11*b* is mainly composed of an electrode tip 12, an intermediate member 13, a first melt portion 241 and a second melt portion 45. In these components, the configuration similar to the first embodiment can be applied to the electrode tip 12, the intermediate member 13 and the second melt portion 45.

In the spark plug 1 according to the present embodiment, the shape of the first melt portion 241 is different from the shape of the first melt portion 41 in the first embodiment.

As shown in FIG. 6, in an arbitrary cross section including an axis O of the projection part 11*b*, the first melt portion 241 includes, in the boundary with the intermediate member 13, two first projection portions 242*a* and 242*b* projecting toward the electrode tip 12 side. The first projection portions 242*a* and 242*b* are formed so as to be circumferentially continued with each other along the circumference of a circle with the axis O as a center.

In addition, as shown in FIG. 6, in an arbitrary cross section including the axis O of the projection part 11*b*, the first melt portion 241 includes, in the boundary with the electrode base material 11*a*, two second projection portions 243*a* and 243*b* projecting toward the electrode base material 11*a* side (that is, the opposite side of the first projection portions 242*a* and 242*b*). The second projection portions 243*a* and 243*b* are formed so as to be circumferentially continued with each other along the circumference of a circle with the axis O as a center.

Then, the first melt portion 241 includes a penetration portion 244 between the first projection portions 242*a* and 242*b* and between the second projection portions 243*a* and 243*b* (that is, in the middle part of a circle with the axis O as a center). This penetration portion 244 is filled with the material of the intermediate member 13. In this way, the first melt portion 241 has a substantially doughnut shape having an opening (that is, the penetration portion 244) in the middle.

In the spark plug 1 according to the present embodiment, in an arbitrary cross section including the axis O of the projection part 11*b*, the first melt portion 241 includes the first projection portions 242*a* and 242*b* projecting toward the electrode tip 12 side, and the penetration portion 244 provided therebetween, thereby increasing the surface area of the first melt portion 241 in the boundary between the first melt portion 241 and the intermediate member 13. In addition, in an arbitrary cross section including the axis O of the projection part 11*b*, the first melt portion 241 includes the second projection portions 243*a* and 243*b* projecting toward the electrode base material 11*a* side, and the penetration portion 244 provided therebetween, thereby increasing the surface area of the first melt portion 241 in the boundary between the first melt portion 241 and the electrode base material 11*a*.

Consequently, it is possible to increase the joining strength between the electrode base material 11*a* and the intermediate member 13 which are joined to each other via the first melt portion 241.

The following summarizes features of the present embodiments.

A spark plug in one aspect of the present invention is provided with a center electrode and a ground electrode. In this spark plug, the ground electrode includes an electrode tip having a facing surface facing a distal end portion of the center electrode; an electrode base material supporting the electrode tip; an intermediate member disposed between the electrode tip and the electrode base material; and a melt portion containing a component of the electrode base material and a component of the intermediate member, and disposed at least at a part of a boundary between the electrode base material and the intermediate member. In addition, a part of the melt portion which is formed at a position radially inside the facing surface includes, when observing a cross section including an axis of the ground electrode, a boundary line between the intermediate member and the melt portion which has at least two first projection portions projecting toward an electrode tip side and a boundary line between the electrode base material and the melt portion which has at least two second projection portions projecting toward an opposite side of the first projection portions. According to the above configuration, in a cross section including the axis of the ground electrode, the boundary line between the intermediate member and the melt portion includes at least the two first projection portions projecting toward the electrode tip side, thereby increasing the surface area of the melt portion in the boundary between the melt portion and the intermediate member. In addition, in the cross section of the ground electrode, the boundary line between the electrode base material and the melt portion includes at least the two second projection portions projecting toward the opposite side of the first projection portions, thereby increasing the surface area of the melt portion in the boundary between the melt portion and the electrode base material. Consequently, it is possible to increase the joining strength between the electrode base material and the intermediate member which are joined to each other via the melt portion.

In the spark plug in another aspect of the present invention, the intermediate member includes a body portion positioned on an electrode tip side and a flange portion positioned on an electrode base material side and having a diameter larger than that of the body portion, and, in the cross section including the axis of the ground electrode, a height of at least one of the first projection portions is higher than that of the flange portion in an axial direction. According to the above configuration, a ground electrode having a structure in which the intermediate member hardly moves in the radial direction of the electrode tip can be obtained. Consequently, it is possible to further increase the joining strength between the electrode base material and the intermediate member which are joined to each other via the melt portion.

As the above, according to a spark plug in one aspect of the present invention, it is possible to increase the joining strength between a ground electrode base material and an intermediate member.

The entire contents of Japanese Patent Application 2020-138501 filed Aug. 19, 2020 is incorporated herein by reference.

Although the present invention has been described with reference to the present embodiments and its variations, the present embodiments and its variations are intended to facilitate understanding of the present invention and are not intended to limit the present invention thereto. Various changes and modifications may be made to the present embodiments and its variations without departing from the scope of the present invention. The present invention includes equivalents thereof. In addition, a configuration obtained in the combination of the configurations of the embodiments different from each other which have been explained in the present specification is also included in the scope of the present invention.

The invention claimed is:

1. A spark plug comprising:

a center electrode; and a ground electrode, wherein the ground electrode includes:

an electrode tip having a facing surface facing a distal end portion of the center electrode;

an electrode base material supporting the electrode tip;

an intermediate member disposed between the electrode tip and the electrode base material; and a melt portion containing a component of the electrode base material and a component of the intermediate member, and disposed at least at a part of a boundary between the electrode base material and the intermediate member, and wherein a part of the melt portion which is formed at a position radially inside the facing surface includes, when observing a cross section including an axis of the ground electrode, a boundary line between the intermediate member and the melt portion which has at least two first projection portions projecting toward an electrode tip side and a boundary line between the electrode base material and the melt portion which has at least two second projection portions projecting toward an opposite side of the first projection portions.

2. The spark plug according to claim 1, wherein the intermediate member includes a body portion positioned on an electrode tip side and a flange portion positioned on an electrode base material side, and having a diameter larger than that of the body portion, and wherein, in the cross section including the axis of the ground electrode, a height of at least one of the first projection portions is higher than that of the flange portion in an axial direction.

* * * * *